US009803640B2

(12) United States Patent
Yamazaki

(10) Patent No.: US 9,803,640 B2
(45) Date of Patent: Oct. 31, 2017

(54) NEGATIVE PRESSURE PUMP AND CYLINDER HEAD COVER

(71) Applicant: SANOH INDUSTRIAL CO., LTD., Tokyo (JP)

(72) Inventor: Nobushi Yamazaki, Koga (JP)

(73) Assignee: SANOH INDUSTRIAL CO., LTD., Tokyo (JP)

( * ) Notice: Subject to any disclaimer, the term of this patent is extended or adjusted under 35 U.S.C. 154(b) by 98 days.

(21) Appl. No.: 14/914,316

(22) PCT Filed: Sep. 19, 2014

(86) PCT No.: PCT/JP2014/074963
§ 371 (c)(1),
(2) Date: Feb. 25, 2016

(87) PCT Pub. No.: WO2015/053064
PCT Pub. Date: Apr. 16, 2015

(65) Prior Publication Data

US 2016/0208802 A1 Jul. 21, 2016

(30) Foreign Application Priority Data

Oct. 7, 2013 (JP) ..... 2013-210337

(51) Int. Cl.
*F04C 18/00* (2006.01)
*F04C 18/34* (2006.01)
(Continued)

(52) U.S. Cl.
CPC ..... *F04C 25/02* (2013.01); *F04C 18/3441* (2013.01); *F04C 18/3442* (2013.01)

(58) Field of Classification Search
CPC ... F04C 18/3441; F04C 18/3442; F04C 25/02
(Continued)

(56) References Cited

U.S. PATENT DOCUMENTS 3,386,648 A 6/1968 Van Rossem
3,499,600 A * 3/1970 McGregor ..... F01C 21/106 418/150
(Continued)

FOREIGN PATENT DOCUMENTS

CH 574042 A5 3/1976
DE 10012406 A1 9/2001
(Continued)

OTHER PUBLICATIONS

Search Report and Written Opinion in International Application No. PCT/JP2014/074963 dated Dec. 2, 2014, 6 pages (with English translation of search report).
(Continued)

*Primary Examiner* — Mark Laurenzi
*Assistant Examiner* — Dapinder Singh
(74) *Attorney, Agent, or Firm* — Marshall, Gerstein & Borun LLP

(57) ABSTRACT

A negative pressure pump includes an electrically insulative casing an electrically conductive rotary shaft and an electrically conductive vane. The casing is formed in a tubular shape, an axial direction one end of which is closed off by a cap body. The rotary shaft is disposed in the casing, is mechanically and electrically connected to an earthed power source, and is rotated by power being transmitted from the power source. The vane is disposed in the casing, is supported at the rotary shaft to freely reciprocate in a direction orthogonal to the rotary shaft, and is electrically connected to the power source via the rotary shaft. The vane rotates integrally with the rotary shaft, and end portions of the vane slide over an inner wall face of the casing. The vane divides the interior of the casing into a plurality of spaces and generates negative pressure.

10 Claims, 6 Drawing Sheets

(51) Int. Cl.
*F04C 25/02* (2006.01)
*F04C 18/344* (2006.01)

(58) Field of Classification Search
USPC ..... 418/179
See application file for complete search history.

(56) References Cited

U.S. PATENT DOCUMENTS

| | | | | |
|---|---|---|---|---|
| 5,213,491 | A * | 5/1993 | Fujiwara | F01C 21/0863 418/133 |
| 7,234,344 | B2 | 6/2007 | Inagaki et al. | |
| 7,588,433 | B2 * | 9/2009 | Kishi | F04C 18/3442 418/112 |
| 8,449,277 | B2 * | 5/2013 | Sakakibara | F04C 18/3441 418/188 |

FOREIGN PATENT DOCUMENTS

| | | | |
|---|---|---|---|
| JP | 2005-098285 | | 4/2005 |
| JP | 2006-070805 | | 3/2006 |
| JP | 2006-077633 | | 3/2006 |
| JP | 4600654 | B2 | 12/2010 |
| WO | WO-2006/005380 | A1 | 1/2006 |

OTHER PUBLICATIONS

Extended European Search Report in EP Application No. 14852572.8 dated May 8, 2017, 7 pages.

* cited by examiner

NEGATIVE PRESSURE PUMP AND CYLINDER HEAD COVER

TECHNICAL FIELD

The present invention relates to a negative pressure pump and a cylinder head cover.

BACKGROUND ART

Japanese Patent No. 4,600,654 discloses a negative pressure pump that generates negative pressure from power from an engine. This negative pressure pump is equipped with a housing formed of an aluminium-based material and a vane formed of an aluminium-based material that rotates inside the housing. Portions of the vane (vane end portions) that slide over an inner wall face of the housing are formed of a resin.

SUMMARY OF INVENTION

Technical Problem

However, in Japanese Patent No. 4,600,654, because the housing (a casing) and the vane end portions are formed of different materials, the housing and the vane end portions are electrically charged by frictional electrification during operation of the negative pressure pump.

An object of the present invention is to provide a negative pressure pump and a cylinder head cover that may suppress charging by frictional electrification of a casing and a vane that rotates inside the casing.

Solution to Problem

A negative pressure pump according to a first aspect of the present invention includes: an electrically insulative casing that is formed in a tubular shape, an axial direction one end of the casing being closed off by a cap body; an electrically conductive rotary shaft that is disposed in the casing, the rotary shaft being mechanically and electrically connected to an earthed power source, the rotary shaft being rotated by power being transmitted from the power source, and a rotation center of the rotary shaft being disposed to be offset relative to a center of the casing; and an electrically conductive vane that is disposed in the casing, the vane being supported at the rotary shaft to freely reciprocate in a direction orthogonal to the rotary shaft and being electrically connected to the power source via the rotary shaft, the vane rotating integrally with the rotary shaft and end portions of the vane sliding over an inner wall face of the casing, and the vane dividing the interior of the casing into plural spaces and generating negative pressure.

In the negative pressure pump of the first aspect, when power is transmitted from the power source and the rotary shaft rotates, the vane rotates integrally with the rotary shaft. As a result of this rotation, the vane is subjected to centrifugal force and moves in the direction orthogonal to the rotary shaft (a diametric direction of the rotary shaft), and the end portions of the vane slide over the inner wall face of the casing. Because the rotation center of the rotation axis is at a position that is offset relative to the center of a pump chamber, the volumes of the plural spaces divided apart by the vane are increased and reduced by the rotary shaft and the vane rotating integrally. Thus, air is sucked into, compressed in and discharged from the spaces that are increased and reduced in volume by the vane, and negative pressure is generated.

In this negative pressure pump, because the power source that is earthed (grounded) and the vane are electrically connected via the rotary shaft, static electricity (charge) that is produced by frictional electrification due to the sliding of the vane end portions against the inner wall face of the casing may escape (flow) from the vane through the rotary shaft and the power source to earth. Therefore, charging by frictional electrification of the casing and the vane may be suppressed.

In a negative pressure pump according to a second aspect of the present invention, in the negative pressure pump according to the first aspect, the casing is formed of a resin with electrical insulativity.

In the negative pressure pump of the second aspect, because the casing is formed of the resin with insulativity, a fabrication cost of the casing is kept lower than in, for example, a structure in which a casing is formed of a metal material.

A negative pressure pump according to a third aspect of the present invention includes: an electrically insulative casing that is formed in a tubular shape, an axial direction one end of the casing being closed off by a cap body; an electrically conductive rotary shaft that is disposed in the casing, the rotary shaft being mechanically and electrically connected to an earthed power source, the rotary shaft being rotated by power being transmitted from the power source, and a rotation center of the rotary shaft being disposed to be offset relative to a center of the casing; and an electrically conductive vane that is disposed in the casing, the vane being supported at the rotary shaft to freely reciprocate in a direction orthogonal to the rotary shaft and being electrically connected to the power source via the rotary shaft, the vane rotating integrally with the rotary shaft and end portions of the vane sliding over an inner wall face of the casing, and the vane dividing the interior of the casing into a plurality of spaces and generating negative pressure.

In the negative pressure pump of the third aspect, when power is transmitted from the power source and the rotary shaft rotates, the vane rotates integrally with the rotary shaft. As a result of this rotation, the vane is subjected to centrifugal force and moves in the direction orthogonal to the rotary shaft (the diametric direction of the rotary shaft), and the end portions of the vane slide over the inner wall face of the casing. Because the rotation center of the rotation axis is at a position that is offset relative to the center of a pump chamber, the volumes of the plural paces divided apart by the vane are increased and reduced by the rotary shaft and the vane rotating integrally. Thus, air is sucked into, compressed in and discharged from the spaces that are increased and reduced in volume by the vane, and negative pressure is generated.

In this negative pressure pump, because the power source that is earthed (grounded) and the vane are electrically connected via the rotary shaft, static electricity (charge) that is produced by frictional electrification due to the sliding of the vane end portions against the inner wall face of the casing may escape (flow) from the vane through the rotary shaft and the power source to earth. Therefore, charging by frictional electrification of the casing and the vane may be suppressed.

In a negative pressure pump according to a fourth aspect of the present invention, in the negative pressure pump according to the third aspect, the casing is formed of an electrically conductive resin.

In the negative pressure pump of the fourth aspect, because the casing is formed of the resin with conductivity, fabrication of the casing is easier (molding is easier) than in, for example, a structure in which the casing is formed of a metal material.

In a negative pressure pump according to a fifth aspect of the present invention, in the negative pressure pump according to the fourth aspect, the resin forming the casing contains a conductive filler.

In the negative pressure pump of the fifth aspect, the conductivity (electrical conductivity) of the casing may be adjusted by adjustment of a content amount of the conductive filler relative to the resin. Moreover, abrasion resistance of the casing (abrasion resistance with respect to the sliding of the vane) is improved by, for example, carbon, a metal or the like being used as the conductive filler.

In a negative pressure pump according to a sixth aspect of the present invention, in the negative pressure pump according to any one of the first to fifth aspects, the vane is wholly formed of an electrically conductive resin.

In the negative pressure pump of the sixth aspect, because the vane is wholly formed of the resin with conductivity, static electricity (charge) that is produced by, for example, frictional electrification of the cap body and the vane may also escape (flow) through the rotary shaft to earth. Moreover, fabrication of the vane is easier (molding is easier) than in, for example, a structure in which the vane is formed of the metal material.

In a negative pressure pump according to a seventh aspect of the present invention, in the negative pressure pump according to the sixth aspect, the resin forming the vane contains a conductive filler.

In the negative pressure pump of the seventh aspect, the conductivity (electrical conductivity) of the vane may be adjusted by adjustment of a content amount of the conductive filler relative to the resin. Moreover, abrasion resistance of the vane is improved by, for example, carbon, a metal or the like being used as the conductive filler.

A cylinder head cover according to an eighth aspect of the present invention includes the negative pressure pump according to any one of the first to seventh aspects in which, one portion of the cylinder head cover structures the casing and another portion of the cylinder head cover covers a cylinder head of an engine that serves as the power source.

In the cylinder head cover of the eighth aspect, because the one portion of the cylinder head cover structures the casing, fabrication costs may be reduced compared to, for example, a structure in which a cylinder head cover and a casing of a negative pressure pump are separate bodies. Because the cylinder head cover is equipped with the negative pressure pump according to any one of the first to seventh aspects, the operational effects provided by the negative pressure pump are realized.

Advantageous Effects of Invention

According to the negative pressure pump and cylinder head cover of the present invention, charging by frictional electrification of the casing and the vane may be suppressed.

DESCRIPTION OF EMBODIMENTS

—First Exemplary Embodiment—

Figure 1:
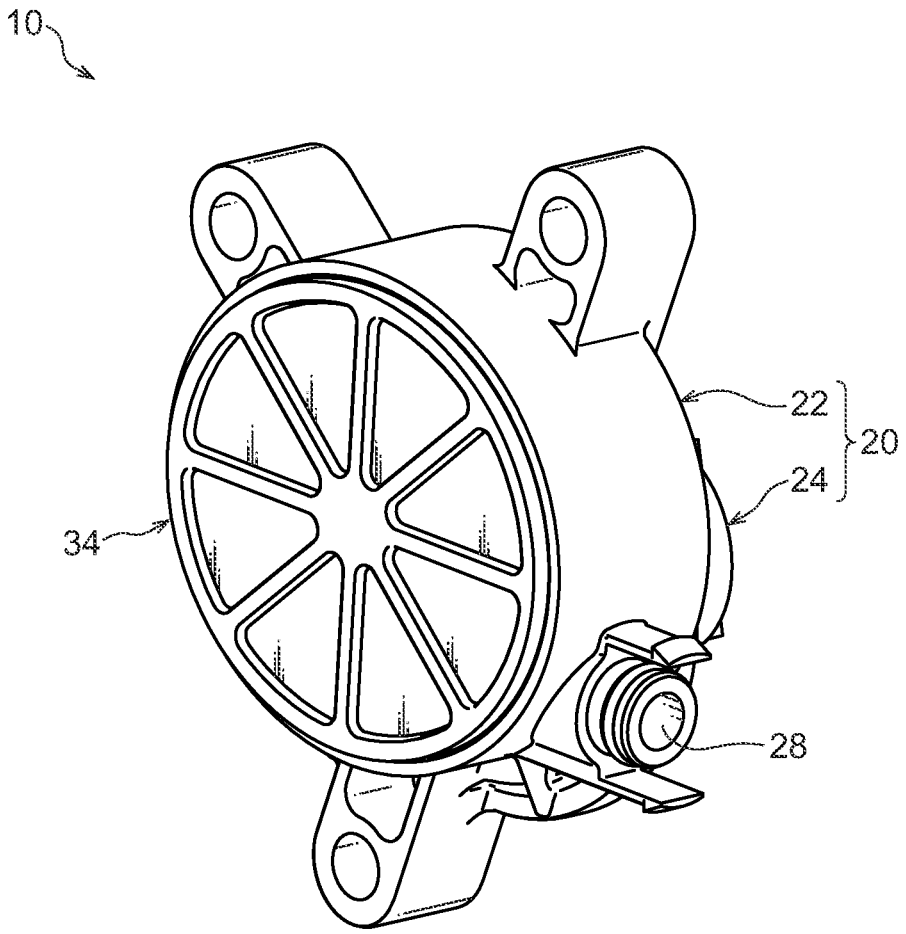
FIG. 1 is a perspective view of a negative pressure pump in accordance with a first exemplary embodiment of the present invention.

A negative pressure pump according to the first exemplary embodiment of the present invention is described.

A negative pressure pump 10 according to the present exemplary embodiment (see FIG. 1) is a device that uses an engine as a power source to generate negative pressure. The negative pressure pump 10 is used for a negative pressure-type brake booster apparatus (not shown in the drawings) of a vehicle. The present invention is not limited to the above structure but may use a motor or the like as a power source of the negative pressure pump. The negative pressure pump of the present invention may be used for an apparatus other than a negative pressure-type brake booster apparatus, provided that apparatus utilizes negative pressure.

Figure 2:
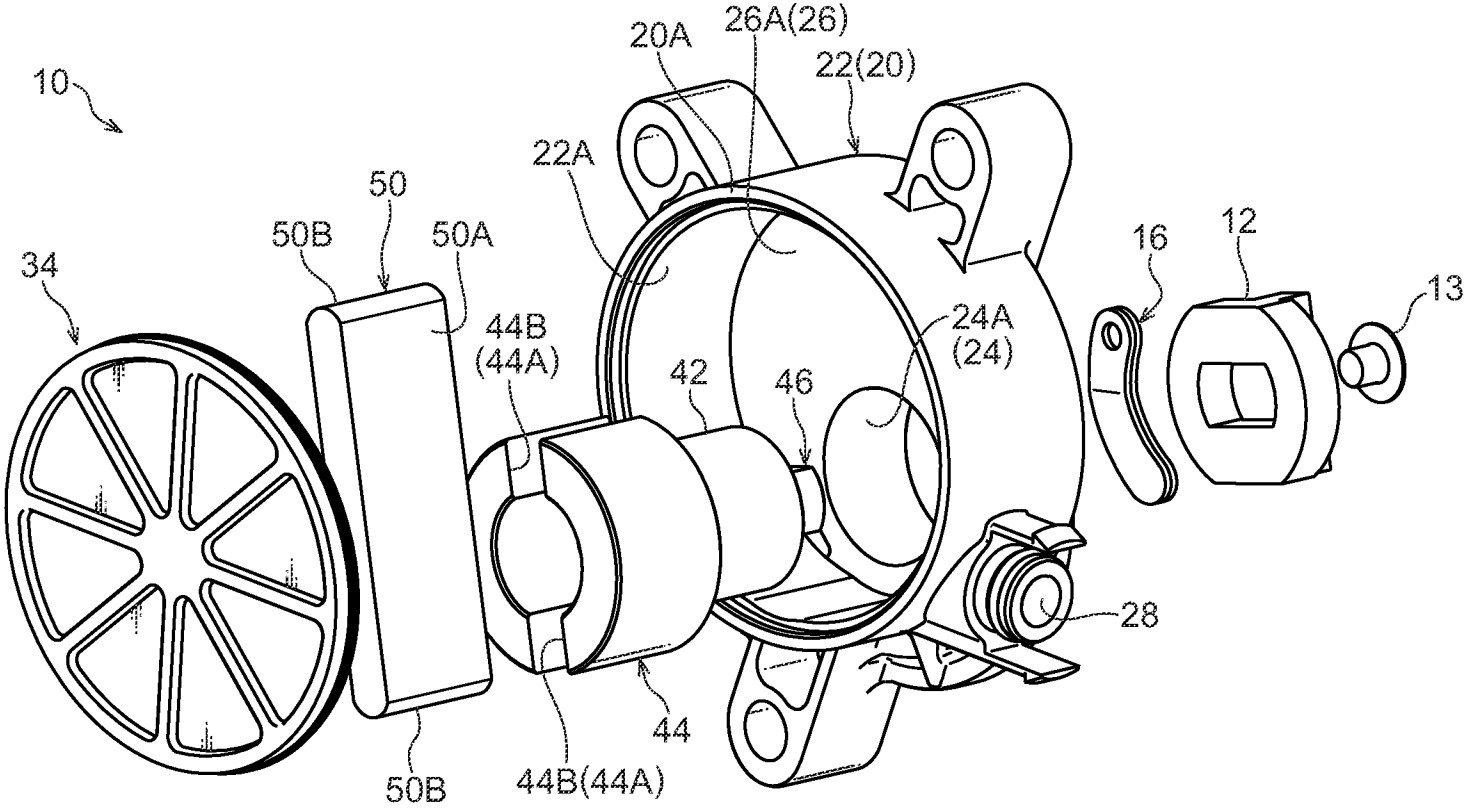
FIG. 2 is an exploded perspective view of the negative pressure pump in FIG. 1.
Figure 3:
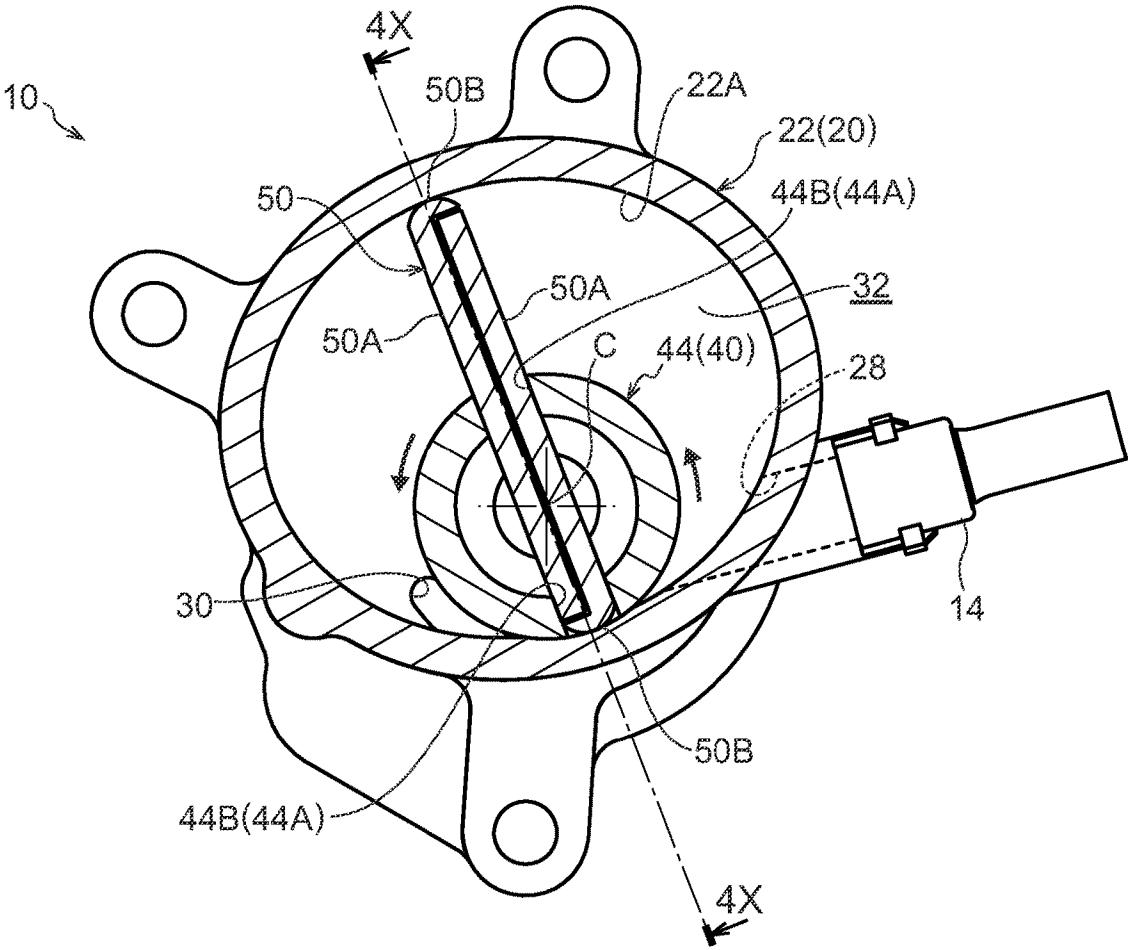
FIG. 3 is a sectional diagram in which a casing of the negative pressure pump in FIG. 1 is cut along a direction orthogonal to an axis thereof.
Figure 4:
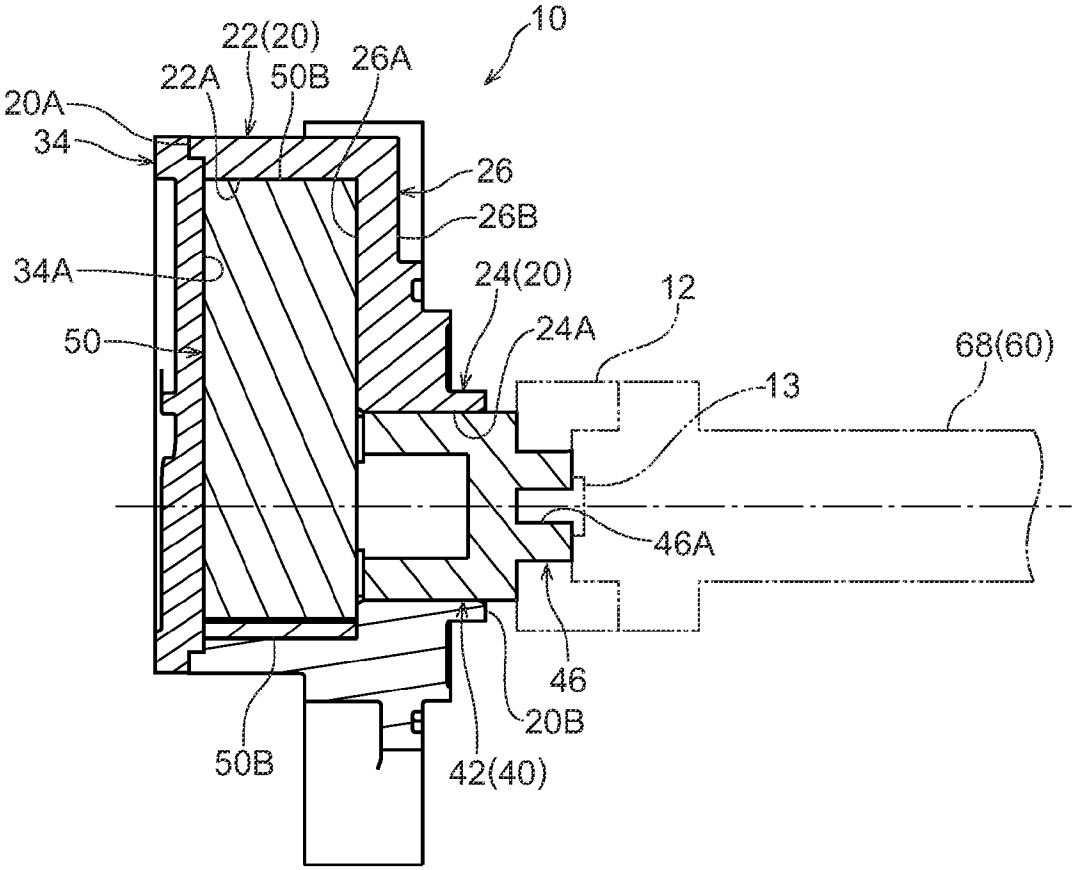
FIG. 4 is a sectional diagram in which the negative pressure pump in FIG. 3 is cut along line 4X-4X.

As shown in FIG. 2 to FIG. 4, the negative pressure pump 10 is formed in a tubular shape and includes a casing 20 with electrical insulativity, a rotary shaft 40 with electrical conductivity and a vane 50 with electrical conductivity. An axial direction one end 20A of the casing 20 (the end portion at the left side in FIG. 4) is closed off by a cap portion 34. The rotary shaft 40 is disposed inside the casing 20. The vane 50 is disposed inside the casing 20 and is supported at the rotary shaft 40.

The term "tubular shape" as used in the present exemplary embodiment encompasses circular tube shapes, elliptical tube shapes (oval tube shapes), polygonal tube shapes in which the cross-sectional shape of an inner wall face is circular or elliptical (oval), and complex tube shapes in which these tube shapes are combined. The term "tubular shape" further encompasses tubular shapes whose inner diameter changes along the axial direction.

As shown in FIG. 3 and FIG. 4, the casing 20 includes an elliptical cylinder portion 22, a circular cylinder portion 24 and a step portion 26. The elliptical cylinder portion 22 structures the axial direction one side of the casing 20 (the left side in FIG. 4) in an elliptical tube shape. The circular cylinder portion 24 structures an axial direction other side of the casing 20 (the right side in FIG. 4) in a circular tube shape with a diameter smaller than the elliptical cylinder portion 22. The step portion 26 is formed between the elliptical cylinder portion 22 and the circular cylinder portion 24 and joins the elliptical cylinder portion 22 with the circular cylinder portion 24.

As shown in FIG. 3, the cross-sectional shape of an inner periphery face 22A of the elliptical cylinder portion 22 is an ellipse. An end portion at the axial direction one side of the elliptical cylinder portion 22 (the left side in FIG. 4) structures the one end 20A of the casing 20.

An intake port 28 is provided at the elliptical cylinder portion 22 for sucking a fluid (in the present exemplary embodiment, a gas (for example, air)) into the interior of the elliptical cylinder portion 22. A check valve 14 with a non-return function is connected to the intake port 28. The intake port 28 and the negative pressure-type brake booster apparatus (not shown in the drawings) are connected via the check valve 14.

The check valve 14 is structured to allow flows of fluid (in this case, air) from the negative pressure-type brake booster apparatus toward the intake port 28 but block flows of fluid (in this case, air and lubricating oil) from the intake port 28 toward the negative pressure-type brake booster apparatus.

The cross-sectional shape of an inner periphery face 24A of the circular cylinder portion 24 is a circle. A center of the circular cylinder portion 24 is disposed at a position that is offset relative to a center of the elliptical cylinder portion 22. The rotary shaft 40 is rotatably fitted into the circular cylinder portion 24. An end portion at the axial direction other side of the circular cylinder portion 24 (the right side in FIG. 4) structures another end 20B of the casing 20 (the end portion at the right side in FIG. 4).

As shown in FIG. 4, the step portion 26 is formed by a radial step between the elliptical cylinder portion 22 and the circular cylinder portion 24. In the present exemplary embodiment, the step portion 26 lies along a direction orthogonal to the axial direction of the casing 20. A discharge port 30 (see FIG. 3) is provided at the step portion 26 for discharging fluid inside the casing 20 (in this case, air and lubricating oil). The discharge port 30 is closed off by a discharge valve 16 (see FIG. 2) with flexibility that is screwed into an outer face 26B of the step portion 26. The discharge valve 16 is structured to allow flows of fluid (in this case, air and lubricating oil) from the inside of the casing 20 (the elliptical cylinder portion 22) to the outside but block flows of fluid (in this case, air and lubricating oil) from the outside to the inside of the casing 20 (into the elliptical cylinder portion 22).

As shown in FIG. 2 and FIG. 4, the cap portion 34, in a plate shape, is detachably mounted at the end portion at the axial direction one side of the elliptical cylinder portion 22 structuring the one end 20A of the casing 20 (see FIG. 1). In specific terms, a male thread (not shown in the drawings) formed at the cap portion 34 is screwed into a female thread (not shown in the drawings) formed at the axial direction one side of the elliptical cylinder portion 22. Thus, the cap portion 34 is detachably mounted to the casing 20.

A sealing member (not shown in the drawings) is provided at a portion of the elliptical cylinder portion 22 that opposes the cap portion 34. In the state in which the cap portion 34 is mounted to the casing 20 (the elliptical cylinder portion 22), leakages between the cap portion 34 and the casing 20 (the elliptical cylinder portion 22) of fluids supplied into the elliptical cylinder portion 22 (lubricating oil and air) may be prevented by this sealing member.

As shown in FIG. 3, in the present exemplary embodiment the interior space of the elliptical cylinder portion 22 forms a pump chamber 32. In specific terms, the pump chamber 32 is structured by the inner periphery face 22A of the elliptical cylinder portion 22, an inner face 26A of the step portion 26, and a closing face 34A of the cap portion 34. The inner periphery face 22A of the elliptical cylinder portion 22 according to the present exemplary embodiment is an example of an inner wall face of a casing of the present invention.

The casing 20 is formed of a resin featuring electrical insulativity. Any of thermosetting resins and thermoplastic resins may be used as this resin. Thermosetting resins that can be mentioned are, for example, phenol resins, urea resins, melamine resins, epoxy resins and the like. Alternatively, thermoplastic resins that can be mentioned are, for example, urethane resins, olefin resins, vinyl chloride resins, polyacetal resins, polyamide resins, polyimide resins and the like. In the present exemplary embodiment, with a view to toughness and flexibility, the resin that forms the casing 20 is a polyamide resin (for example, nylon). In the present exemplary embodiment, the casing 20 is a single molded piece of the resin.

Similarly to the casing 20, the cap portion 34 is formed of a resin featuring insulativity. The resin that forms the cap portion 34 may be the same as the resin that forms the casing 20 or may be different. In the present exemplary embodiment, the cap portion 34 is formed of a resin the same as the resin that forms the casing 20.

As shown in FIG. 2 and FIG. 4, the rotary shaft 40 includes a circular tube portion 42, a circular tube portion 44 and an engaging protrusion portion 46. The circular tube portion 44 is formed at the axial direction one side relative to the circular tube portion 42 (the left side in FIG. 4) and has a larger diameter than the circular tube portion 42. The engaging protrusion portion 46 is formed at the axial direction other side relative to the circular tube portion 42 (the right side in FIG. 4) and engages with an Oldham coupling 12, which is described below. The circular tube portion 42 and circular tube portion 44 are made coaxial. A rotation center C of the rotary shaft 40 that is fitted into the circular cylinder portion 24 is disposed at a position (see FIG. 3) that is offset relative to the center of the elliptical cylinder portion 22 (the pump chamber 32).

The circular tube portion 42 is a portion that rotatably fits into the circular cylinder portion 24 of the casing 20. Although not shown in the drawings, a lubricating oil supply channel is formed in the circular tube portion 42 for supplying lubricating oil into the pump chamber 32.

The circular tube portion 44 is disposed inside the elliptical cylinder portion 22 (inside the pump chamber 32). A slot 44A is formed in the circular tube portion 44. The slot 44A extends in a direction orthogonal to the axial direction of the rotary shaft 40, that is, the diametric direction of the rotary shaft 40. The circular tube portion 44 is divided in half by the slot 44A. In the present exemplary embodiment, an outer periphery face of the circular tube portion 44 is in contact with the inner periphery face 22A of the elliptical cylinder portion 22, but the present invention is not limited to this structure.

As shown in FIG. 4, the engaging protrusion portion 46 is disposed outside the casing 20. A screw hole 46A is formed in a distal end portion of the engaging protrusion portion 46. The engaging protrusion portion 46 is fitted into an engaging recess portion formed in the Oldham coupling 12, which features conductivity (see FIG. 2). In this state, a screw 13 is screwed into the screw hole 46A and the engaging protrusion portion 46 is coupled to the Oldham coupling 12. The Oldham coupling 12 is coupled to a camshaft 68, which is a structural member of an engine 60. Consequently, when the camshaft 68 turns, the rotary shaft 40 is rotated via the Oldham coupling 12 (i.e., power is transmitted). That is, the rotary shaft 40 is mechanically connected to the camshaft 68 (the engine 60) via the Oldham coupling 12. The rotary shaft 40 is also electrically connected to the camshaft 68 via the Oldham coupling 12. The meaning of the term "electrically connected" as used here refers to respective members with conductivity being in contact with one another such that electricity can flow therethrough.

The engine 60 according to the present exemplary embodiment is ordinarily structured with a cylinder block 62, a cylinder head 64, a crankshaft (not shown in the drawings), a timing chain (or timing belt) 66 and the camshaft 68. Structural members of the engine 60 are formed of metal materials and are electrically connected together. One structural member (for example, the cylinder block 62) is earthed (earthed to a vehicle body or the like). A cylinder head cover (not shown in the drawings) is mounted at the cylinder head 64, and the casing 20 is fixed to the cylinder head cover by screws. The cylinder block 62, cylinder head 64 and timing chain 66 are not shown in the drawing of FIG. 4.

Because the rotary shaft 40 is a member that transmits power of the engine 60 from the camshaft 68 via the Oldham coupling 12, the rotary shaft 40 is formed of a metal material (for example, steel or aluminium) with a view to strength. However, provided sufficient strength can be assured, the rotary shaft 40 may be formed of a resin with conductivity.

Similarly to the rotary shaft 40, the Oldham coupling 12 is formed of a metal material (for example, steel or aluminium) with a view to strength. However, provided sufficient strength can be assured, the Oldham coupling 12 may be formed of a resin with conductivity.

In the present exemplary embodiment, the Oldham coupling 12 is used to couple the rotary shaft 40 to the camshaft 68, but the present invention is not limited to this structure. For example, a connector (coupling) with conductivity that is a different structure from the Oldham coupling 12 may be used to couple the rotary shaft 40 to the camshaft 68, and structures are possible in which the rotary shaft 40 is coupled directly to the camshaft 68 without using a connector.

As shown in FIG. 2 and FIG. 3, the vane 50, in a plate shape, is inserted into and disposed in the slot 44A of the circular tube portion 44. Plate faces 50A of the vane 50 are supported by slot walls 44B of the slot 44A to freely reciprocate in the direction orthogonal to the rotary shaft 40 (the diametric direction of the rotary shaft 40). Thus, the vane 50 is structured to rotate integrally with the rotary shaft 40.

When the vane 50 rotates integrally with the rotary shaft 40, the vane 50 is reciprocated in the diametric direction of the rotary shaft 40 by centrifugal force. Thus, two length direction end portions 50B of the vane 50 press against an inner wall face of the pump chamber 32 (the inner periphery face 22A of the elliptical cylinder portion 22) and respectively slide over the inner periphery face 22A. At the same time, an axial direction one end portion of the vane 50 (the end portion at the left side in FIG. 4) slides over the closing face 34A of the cap portion 34, and an axial direction other end portion of the vane 50 (the end portion at the right side in FIG. 4) slides over the inner face 26A of the step portion 26. The interior of the elliptical cylinder portion 22 (the interior of the pump chamber 32) is divided up into plural spaces by the vane 50. The structure is formed such that each divided space progressively becomes smaller in volume from the intake port 28 side toward the discharge port 30 side as the rotary shaft 40 and the vane 50 rotate integrally. Negative pressure is generated in the pump chamber 32 by the changes in volume of the spaces divided apart by the vane 50. In other words, negative pressure is generated in the pump chamber 32 by the rotary shaft 40 and the vane 50 rotating integrally.

The vane 50 is wholly formed of a resin featuring conductivity. A resin containing a conductive filler may be used as this resin with conductivity. Any of thermosetting resins and thermoplastic resins may be used as the resin that is the base material. It is preferable to use a polyphenylene sulfide (PPS) as the resin that is the base material with a view to strength and abrasion resistance of the vane 50, an aromatic polyether ketone (PEEK) with a view to strength and heat resistance of the vane 50, or the like. A metal (for example, copper or silver), carbon (for example, carbon black) or the like in flake form, powder form, fiber form or the like, or a mixture thereof or the like, may be used as the conductive filler. Using carbon as the conductive filler is preferable with a view to strength of the vane 50.

The vane 50 is electrically connected to the rotary shaft 40 via contact surfaces with the rotary shaft 40 (contacting portions of the plate faces 50A and the slot walls 44B. Thus, the vane 50 is electrically connected to the engine 60 via the rotary shaft 40.

—Operation—

Now, operational effects of the negative pressure pump 10 according to the present exemplary embodiment are described.

In the negative pressure pump 10, because the camshaft 68 and the vane 50 are electrically connected via the rotary shaft 40 and the Oldham coupling 12, static electricity (charge) that is generated by frictional electrification due to the end portions 50B of the vane 50 sliding against the inner wall face of the casing 20 (the inner periphery face 22A of the elliptical cylinder portion 22) may escape (flow) from the vane 50 through the rotary shaft 40, the Oldham coupling 12 and the engine 60 to earth. Therefore, charging by frictional electrification of the casing 20 and the vane 50 may be suppressed. As a result, occurrences of electrostatic discharges (sparking) between the casing 20 and the vane 50 and suchlike may be prevented.

In the negative pressure pump 10, because the vane 50 is wholly formed of a resin with conductivity, static electricity (charge) produced by frictional electrification of the cap portion 34 and the vane 50 may also escape (flow) through the rotary shaft to earth. In addition, fabrication of the vane 50 is easier (molding is easier) than in, for example, a structure in which a vane is formed of a metal material).

In the negative pressure pump 10, the conductivity (electrical conductivity) of the vane 50 may be adjusted by adjustment of a content amount of the conductive filler relative to the resin that is the base material.

In the negative pressure pump 10, because the casing 20 is formed of the resin with electrical insulativity, a fabrication cost of the casing 20 is kept lower than in, for example, a structure in which a casing is formed of a metal material. Further, because the casing 20 is formed of a resin, thermal conductivity thereof may be low. Therefore, in low-temperature conditions, releases of heat inside the pump chamber 32 to the exterior (outside the casing 20) are suppressed and lubricating oil is more easily warmed. Therefore, the lubricating oil warms up rapidly in low-temperature conditions and shear resistance of the lubricating oil is reduced. As a result, loads acting on the rotary shaft 40 via the vane 50 are moderated and driving resistance of the negative pressure pump 10 is reduced. In other words, a rise in driving resistance of the negative pressure pump 10 in low-temperature conditions may be suppressed. Hence, an energy loss from the engine 60 that is the power source may be reduced.

In the first exemplary embodiment, the vane 50 is wholly formed of a resin with conductivity, but the present invention is not limited to this structure. Structures are also possible in which a resin layer with conductivity or the like is formed at the surface of the vane 50. Structures are possible in which portions of resin with conductivity are formed at the vane 50 such that contact portions between the casing 20 and the vane 50 are electrically connected with the rotary shaft 40. Structures are also possible in which portions of resin with conductivity are formed at the vane 50 such that contact portions between the casing 20 and the vane 50 and contact portions between the cap portion 34 and the vane 50 are respectively electrically connected with the rotary shaft 40.

In the first exemplary embodiment, the vane 50 is formed of a resin in which the resin that is the base material contains the conductive filler, but the present invention is not limited to this structure. Provided strength of the vane 50 can be assured, a conductive polymer that is inherently conductive (for example, polyacetylene or polythiazyl) may be used.

—Second Exemplary Embodiment—

Now, a cylinder head cover 100 according to a second exemplary embodiment of the present invention is described.

Figure 5:
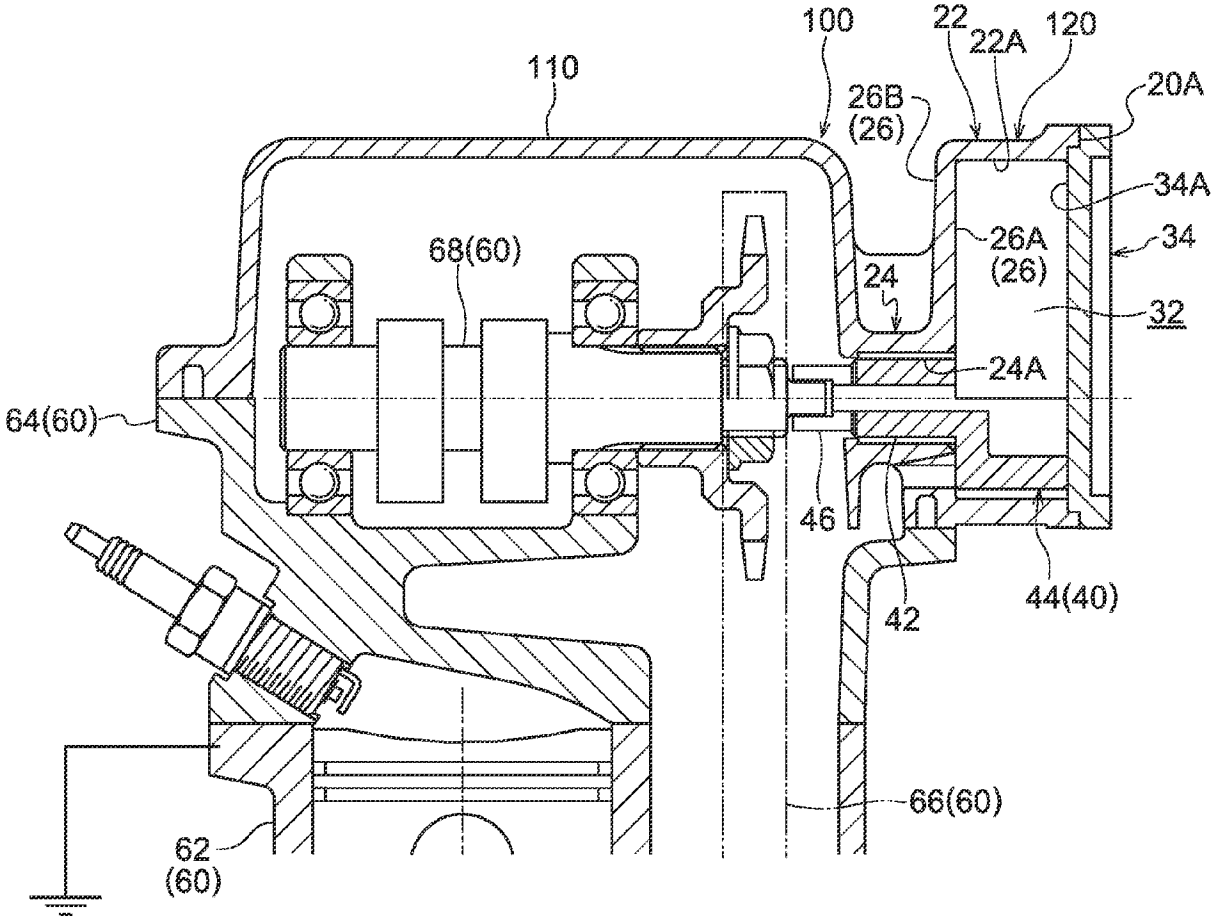
FIG. 5 is a sectional diagram in which a negative pressure pump casing portion of a cylinder head cover in accordance with a second exemplary embodiment is cut along an axial direction thereof.
Figure 6:
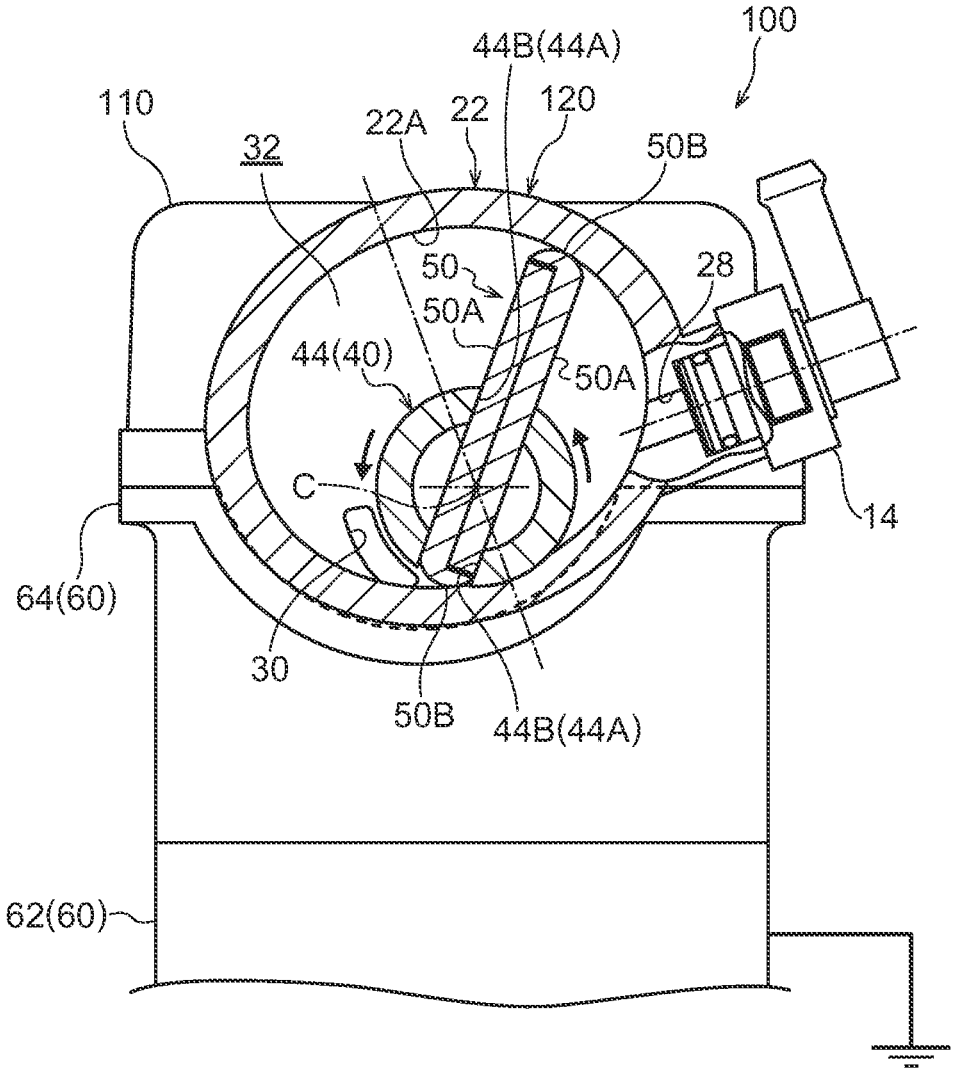
FIG. 6 is a sectional diagram in which the casing of the negative pressure pump in FIG. 5 is cut along a direction orthogonal to the axis.

The cylinder head cover 100 according to the present exemplary embodiment is formed of a resin with insulativity, specifically the same resin as the casing 20 according to the first exemplary embodiment. As shown in FIG. 5 and FIG. 6, one portion of the cylinder head cover 100 serves as a negative pressure pump casing portion 120, with the same shape as the casing 20 of the negative pressure pump 10 according to the first exemplary embodiment, and another portion of the cylinder head cover 100 serves as a cover portion 110 that covers the cylinder head 64 of the engine 60 that is the power source.

Similarly to the negative pressure pump 10 according to the first exemplary embodiment, pump structural members such as the cap portion 34, the rotary shaft 40, the vane 50 and the like are installed at the negative pressure pump casing portion 120. Thus, a negative pressure pump unit similar to the negative pressure pump 10 according to the first exemplary embodiment is structured in the cylinder head cover 100. In the present exemplary embodiment, the rotary shaft 40 is coupled directly with the camshaft 68. Thus, the rotary shaft 40 and the camshaft 68 are electrically connected.

Now, an operational effect of the cylinder head cover 100 according to the present exemplary embodiment is described.

Because the one portion of the cylinder head cover 100 serves as the negative pressure pump casing portion 120, fabrication costs may be lowered compared to, for example, a structure in which a cylinder head cover and the negative pressure pump 10 are formed as separate bodies, as in the first exemplary embodiment.

In the first exemplary embodiment, the casing 20 is a structure with electrical insulativity, but the present invention is not limited to this structure; the casing 20 may be a structure with conductivity. In specific terms, if the casing 20 is formed of a resin with conductivity, the casing 20 has conductivity. A resin containing a conductive filler may be used as this resin with conductivity. Similarly to the vane 50, any of thermosetting resins and thermoplastic resins may be used as the resin that is the base material. It is preferable to use a polyphenylene sulfide (PPS) as the resin that is the base material with a view to strength and abrasion resistance of the casing 20, an aromatic polyether ketone (PEEK) with a view to strength and heat resistance of the casing 20, or the like. Similarly to the vane 50, a metal (for example, copper or silver), carbon (for example, carbon black) or the like in flake form, powder form, fiber form or the like, or a mixture thereof or the like, may be used as the conductive filler. Using carbon as the conductive filler is preferable with a view to strength of the casing 20. If the casing 20 is formed of a material with conductivity thus, then fabrication of the casing 20 is easier (molding is easier) than in, for example, a structure in which a casing is formed of a metal material. Moreover, the conductivity (electrical conductivity) of the casing 20 may be adjusted by adjustment of a content amount of the conductive filler relative to the resin that is the base material. Abrasion resistance of the casing 20 (abrasion resistance with respect to sliding of the vane 50) can be improved by using, for example, carbon or a metal as the conductive filler. Hence, durabilities of the casing 20 and the vane 50 are improved. Even when the casing 20 is formed of a resin with conductivity, operational effects the same as the operational effects provided by the first exemplary embodiment are provided. In addition, the cap portion 34 may be formed of a resin with conductivity similarly to the casing 20.

The above-described structure in which the casing 20 is formed of a resin with conductivity is also applicable to the second exemplary embodiment. If this structure is applied to the second exemplary embodiment, the cylinder head cover 100 is formed of the resin with conductivity.

Specific embodiments of the present invention have been described in detail, but the present invention is not to be limited to the present exemplary embodiments and it will be clear to the ordinary practitioner that numerous alternative embodiments are possible within the technical scope of the invention.

The disclosures of Japanese Patent Application No. 2013-210337 filed Oct. 7, 2013 are incorporated into the present specification by reference in their entirety.

All references, patent applications and technical specifications cited in the present specification are incorporated by reference into the present specification to the same extent as if the individual references, patent applications and technical specifications were specifically and individually recited as being incorporated by reference.

The invention claimed is:

1. A negative pressure pump comprising:

an electrically insulative casing that is formed in a tubular shape, an axial direction one end of the casing being closed off by a cap body;

an electrically conductive rotary shaft that is disposed in the casing, the rotary shaft being mechanically and electrically connected to an earthed power source, the rotary shaft being rotated by power being transmitted from the power source, and a rotation center of the rotary shaft being disposed to be offset relative to a center of the casing; and an electrically conductive vane that is disposed in the casing, the vane being supported at the rotary shaft to freely reciprocate in a direction orthogonal to the rotary shaft and being electrically connected to the power source via the rotary shaft, the vane rotating integrally with the rotary shaft and end portions of the vane sliding over an inner wall face of the casing, and the vane dividing the interior of the casing into a plurality of spaces and generating negative pressure.

2. The negative pressure pump according to claim 1, wherein the casing is formed of an electrically insulative resin.

3. The negative pressure pump according to claim 1, wherein the vane is wholly formed of an electrically conductive resin.

4. The negative pressure pump according to claim 3, wherein the resin forming the vane contains a conductive filler.

5. A cylinder head cover comprising the negative pressure pump according to claim 1, wherein one portion of the cylinder head cover structures the casing and another portion of the cylinder head cover covers a cylinder head of an engine that serves as the power source.

6. A negative pressure pump comprising:

an electrically conductive casing that is formed in a tubular shape, an axial direction one end of the casing being closed off by a cap body;

an electrically conductive rotary shaft that is disposed in the casing, the rotary shaft being mechanically and electrically connected to an earthed power source, the rotary shaft being rotated by power being transmitted from the power source, and a rotation center of the rotary shaft being disposed to be offset relative to a center of the casing; and an electrically conductive vane that is disposed in the casing, the vane being supported at the rotary shaft to freely reciprocate in a direction orthogonal to the rotary shaft and being electrically connected to the power source via the rotary shaft, the vane rotating integrally with the rotary shaft and end portions of the vane sliding over an inner wall face of the casing, and the vane dividing the interior of the casing into a plurality of spaces and generating negative pressure.

7. The negative pressure pump according to claim 6, wherein the casing is formed of an electrically conductive resin.

8. The negative pressure pump according to claim 7, wherein the resin forming the casing contains a conductive filler.

9. The negative pressure pump according to claim 6, wherein the vane is wholly formed of an electrically conductive resin.

10. The negative pressure pump according to claim 9, wherein the resin forming the vane contains a conductive filler.

* * * * *